US006336493B1

(12) United States Patent
Sickels

(10) Patent No.: US 6,336,493 B1
(45) Date of Patent: Jan. 8, 2002

(54) PLEATED WALL COVERING AND METHOD OF MAKING SAME

(75) Inventor: Anthony R. Sickels, Springboro, OH (US)

(73) Assignee: Soundfold, Inc., Centerville, OH (US)

( * ) Notice: Subject to any disclaimer, the term of this patent is extended or adjusted under 35 U.S.C. 154(b) by 0 days.

(21) Appl. No.: 09/615,682

(22) Filed: Jul. 14, 2000

Related U.S. Application Data

(60) Provisional application No. 60/144,150, filed on Jul. 16, 1999.

(51) Int. Cl.[7] ..... A47H 23/00

(52) U.S. Cl. ..... 160/327; 160/348; 52/144

(58) Field of Search ..... 160/327, 328, 160/348, 368.1, 354; 52/222, 144; 181/30, 290, 294

(56) References Cited

U.S. PATENT DOCUMENTS

| | | | | | |
|---|---|---|---|---|---|
| 1,085,948 | A | | 2/1914 | Smith | |
| 1,504,810 | A | * | 8/1924 | Byron | 160/348 |
| 2,126,834 | A | | 8/1938 | Steinberger | |
| 2,144,513 | A | | 1/1939 | Smith | |
| 2,522,358 | A | * | 9/1950 | Franson et al. | 160/348 |
| 2,724,434 | A | * | 11/1955 | Smith | 160/348 |
| 2,821,237 | A | | 1/1958 | Howard | |
| 3,011,174 | A | | 12/1961 | Schaerer | |
| 3,185,207 | A | * | 5/1965 | Humble | 160/327 X |
| 3,399,713 | A | | 9/1968 | Wilson | |
| 3,683,994 | A | | 8/1972 | Eichenlaub | |
| 3,785,426 | A | | 1/1974 | Sperling | |
| 3,896,931 | A | | 7/1975 | Franklin | |
| 3,998,015 | A | * | 12/1976 | Scott et al. | 52/222 |
| 3,999,590 | A | | 12/1976 | Koch | |
| 4,055,211 | A | | 10/1977 | Sperling | |
| 4,058,946 | A | * | 11/1977 | Habrant | 52/273 |
| 4,079,682 | A | | 3/1978 | Nishiwaki | |
| 4,093,483 | A | | 6/1978 | Jacobs | |
| 4,117,180 | A | | 9/1978 | DeWoskin | |
| 4,152,809 | A | | 5/1979 | Wertepny | |
| 4,226,276 | A | | 10/1980 | Bressler | |
| 4,230,171 | A | | 10/1980 | Baker | |
| 4,284,215 | A | | 8/1981 | Nye | |
| 4,342,356 | A | | 8/1982 | Sickels et al. | |
| 4,605,088 | A | * | 8/1986 | Sickels | 181/30 |
| 4,858,668 | A | | 8/1989 | Toti | |
| 4,878,531 | A | | 11/1989 | Stover | |
| 4,915,153 | A | | 4/1990 | Toti | |
| 5,043,038 | A | | 8/1991 | Colson | |
| 5,114,056 | A | | 5/1992 | Frye | |
| 5,323,834 | A | | 6/1994 | Toti | |
| 5,343,925 | A | | 9/1994 | Hannerstig | |

FOREIGN PATENT DOCUMENTS

| | | |
|---|---|---|
| EP | 412081 B1 | 12/1994 |

* cited by examiner

*Primary Examiner*—David M. Purol
(74) *Attorney, Agent, or Firm*—Biebel & French

(57) ABSTRACT

A wall covering system including a pleated material, and the method of producing and installing the plated material. The pleated material includes a plurality of permanently fixed pleats extending in substantially parallel vertical relation to each other. Each pleat includes first and second pleat panels having first ends fixed by a securing line and opposing second ends defining an apex. The apex extends outwardly away from the wall as each pleat converges toward a center line extending between upper and lower portions of each pleat. The method of producing the pleated material includes passing a planar material successively through a pleating die and a securing device to initially form a plurality of pleats simultaneously and thereafter secure the plurality of pleats simultaneously.

17 Claims, 6 Drawing Sheets

PLEATED WALL COVERING AND METHOD OF MAKING SAME

CROSS-REFERENCE TO RELATED APPLICATION

This application claims the benefit of U.S. Provisional Patent Application Ser. No. 60/144,150, filed Jul. 16, 1999.

BACKGROUND OF THE INVENTION

1. Field of the Invention

The present invention relates to wall coverings and, more particularly, to a pleated acoustical wall covering and the methods of production and installation of such pleated acoustical wall covering.

2. Description of the Prior Art

Many devices have been proposed for hanging large sections of fabric for both decorative and sound proofing purposes along the walls of theaters, concert halls and the like. Typically, such devices comprise hanging brackets including pleat forming bends at equally spaced intervals wherein a planar fabric material is wrapped around the bends during installation to produce a pleated appearance to the installed fabric. Examples of such pleating brackets and methods of installation are disclosed in U.S. Pat. Nos. 3,785,426 and 4,342,356, both of which are incorporated herein by reference.

While such pleating brackets have assisted greatly in the formation of pleats during installation, they suffer from several disadvantages. Such brackets are generally bulky and extend a considerable distance outwardly from the wall. Additionally, portions of the brackets are typically visible after the fabric has been installed, thereby detracting from the finished appearance of the final installation. More particularly, conventional pleating brackets have failed to facilitate the installation of decorative trim or facia strips which provide a finished appearance to the wall covering system. Such facia strips are difficult to install against the plurality of bends in traditional pleating brackets.

Moreover, the prior art pleating brackets require considerable time and skill in wrapping the planar fabric material around the pleat forming bends. As may be readily appreciated, this is a time consuming process which requires experienced personnel having considerable skill and practice. Failure to properly wrap the fabric material over the brackets often results in non-parallel or skewed pleats thereby presenting an unattractive appearance.

In apparent recognition of some of the aforementioned shortcomings of various pleat forming brackets, U.S. Pat. No. 4,878,531, which is incorporated herein by reference, discloses support strips having flat surfaces for engaging the wall covering material. However, given the lack of a bracket structure having pleat forming bends for guiding the planar fabric material, great skill is required in order to form uniform and parallel pleats along the entire height and width of a wall to be covered. Even more so than with the aforementioned prior art pleating brackets, skilled installation personnel are required to devote a considerable amount of time and effort to the proper installation, and particularly to the pleat formation, of the wall covering material.

Accordingly, there is a need for a wall covering system which eliminates the need for traditional pleating brackets while providing a structure which facilitates rapid installation and produces an aesthetically pleasing appearance. There is a further need for a material for use within such a wall covering system that does not require brackets having pleat forming bends.

SUMMARY OF THE INVENTION

The present invention provides an acoustical wall covering system including a pleated material fixed between upper and lower mounting strips, or nailers, which extend substantially horizontally and are supported by a wall. The pleated material includes a plurality of pleats extending longitudinally in a substantially vertical direction between the upper and lower mounting strips and permanently fixed along longitudinally extending and continuous securing lines. The securing lines are oriented in a plane extending substantially parallel to the wall. Planar connecting, or overlapping, panels are positioned intermediate adjacent securing lines and are disposed parallel to the wall. The pleats are formed by first and second pleat panels extending outwardly from adjacent the wall. The first and second pleat panels are joined by the securing line at one end and define an apex at an opposing end.

Upper and lower portions of each pleat are fixed to upper and lower planar mounting surfaces of the upper and lower mounting strips respectively. The apex of each pleat adjacent the upper and lower portions thereof are fixed to the mounting strips such that the first and second pleat panels are folded essentially flat in substantially parallel and partially overlapping relation with adjacent connecting panels. As such, a substantially planar surface is defined over which planar mounting surfaces of upper and lower facia strips are mounted for covering the upper and lower mounting strips. The apex of each pleat extends outwardly in spaced relation to the wall as the pleat extends towards a centerline between the upper and lower portions.

The method of producing the pleated material of the present invention comprises the steps of providing a supply source of planar fabric material, providing a pleating die downstream from the supply source, providing a securing device downstream from the pleating die, and providing a take-up device downstream from the securing device. The planar material is pulled from the supply source through the pleating die where a plurality of pleats are formed longitudinally therein in a simultaneous manner. The pleating die may comprise one of many different structures or combinations thereof, including a plurality of rods, bars or wheels for producing the pleats within the fabric.

Next, the newly pleated material is pulled through the securing device where the pleats are permanently and simultaneously fixed along longitudinally extending and continuous securing lines. The securing lines may be formed by numerous means including sewing, adhesive application, or ultrasonic welding. The pleats are folded flat against an adjacent connecting panel and the newly produced pleated material is then supplied to the take-up device, preferably a collection roll. Once the collection roll has acquired sufficient pleated material, it may be transported to a job site for installation.

During installation, the pleated material is unrolled from the collection roll in a length approximately equal to the height of the portion of the wall to be covered. The pleats are arranged in a vertically extending manner wherein the top edge of the material is fixed, preferably by nailing or stapling, to the upper mounting strip. The installer then ensures that the pleats extend substantially vertical plumb before fixing the bottom edge of the material to the lower mounting strip. Excess material is trimmed, and the upper and lower facia strips are fixed to the upper and lower mounting strips to provide a finished appearance to the wall covering system.

Therefore, it is an object of the invention to provide a wall covering system and method of installation which minimizes the time and expense of installation.

It is another object of the invention to provide such a wall covering system and method of installation by which an attractive pleated appearance is created in the wall covering material.

It is still yet another object of the invention to provide a wall covering system including a material having pleats permanently fixed therein along their longitudinal length thereby eliminating the need to form pleats upon installation.

It is a further object of the invention to provide such a wall covering system which eliminates the need for traditional pleating brackets.

It is another object of the invention to provide a wall covering support structure which supports the wall covering material in substantially planar relation to the wall which is covered.

It is a further object of the invention to provide a method of producing a wall covering material having a plurality of permanently fixed pleats.

It is another object of the invention to provide such a method wherein the plurality of pleats are formed simultaneously and then secured simultaneously along a plurality of securing lines.

Other objects and advantages of the invention will be apparent from the following description, the accompanying drawings and the appended claims.

DETAILED DESCRIPTION OF THE PREFERRED EMBODIMENT

Figure 1:
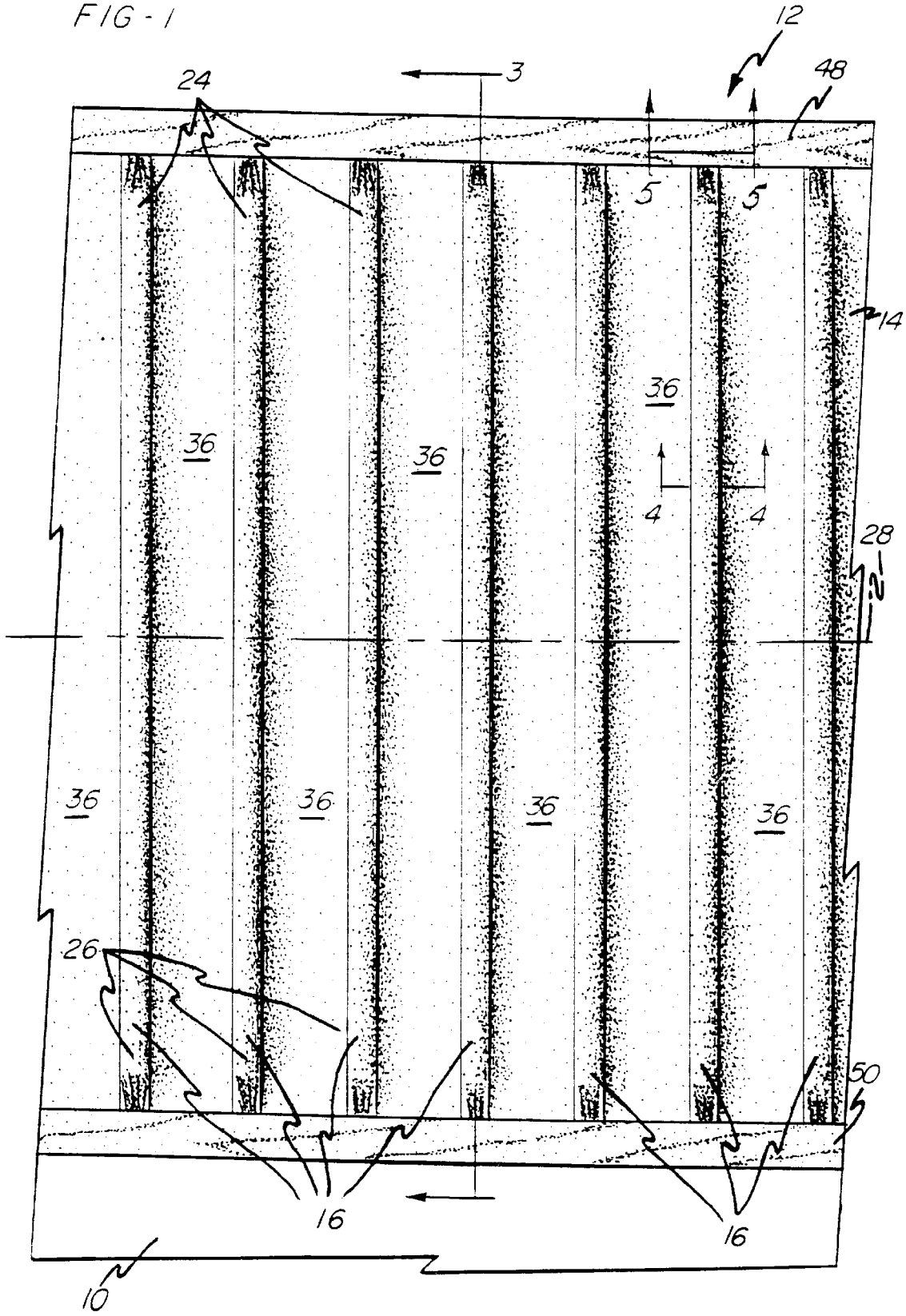
FIG. 1 is a front elevational view of the wall covering system of the present invention.
Figure 2:
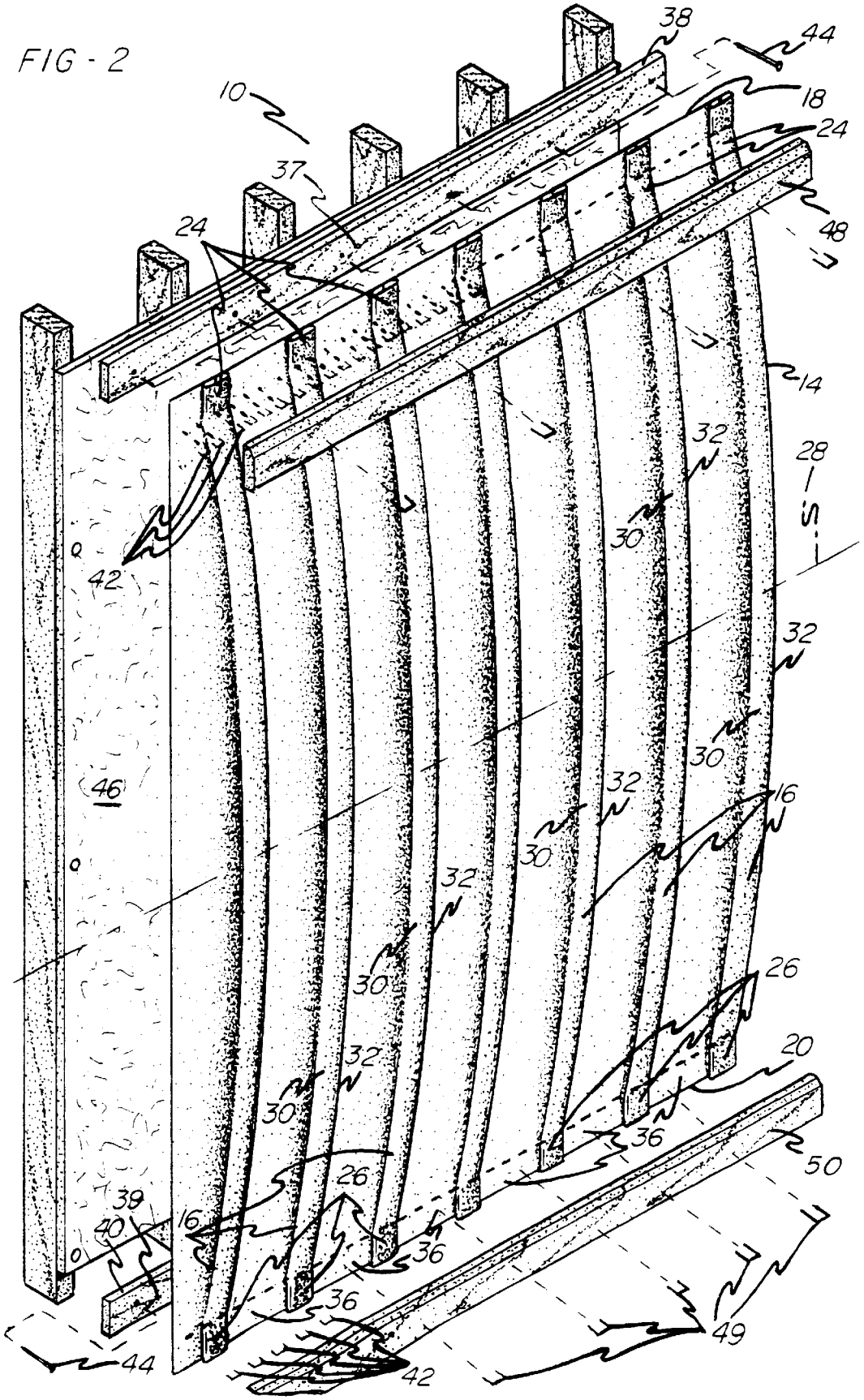
FIG. 2 is a partially exploded perspective view of the wall covering system of FIG. 1.
Figure 3:
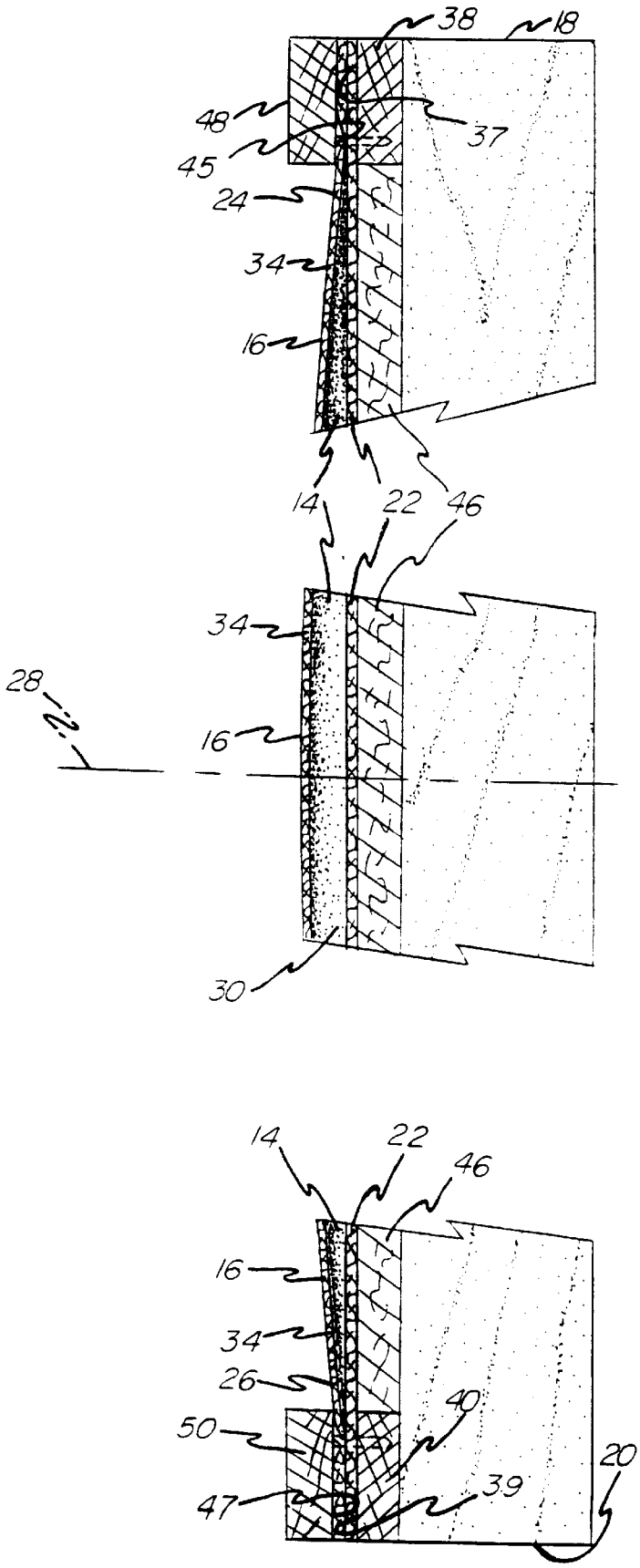
FIG. 3 is a partial cross-sectional view taken along line 3—3 of FIG. 1.

Referring initially to FIGS. 1–3, a vertically extending wall 10 supporting the acoustical wall covering system 12 of the present invention is illustrated. A major portion of the wall 10 is covered by a permanently pleated flexible material 14 manufactured in accordance with the method of production of the present invention and installed in accordance with the method of installation of the present invention.

The pleated material 14 includes a plurality of pleats 16 extending between top and bottom edges 18 and 20. The pleated material 14 is preferably comprised of a flexible fabric, such as a fabric manufactured from polyester fibers, and most preferably comprises a fabric manufactured from Avora™ FR fibers. The pleats 16 are secured along continuous securing lines 22 (FIG. 3) which extend uninterrupted between the top and bottom edges 18 and 20. The pleats 16 include upper and lower portions 24 and 26 adjacent the top and bottom edges 18 and 20 and are centered along a substantially horizontally extending center axis 28.

Figure 4:
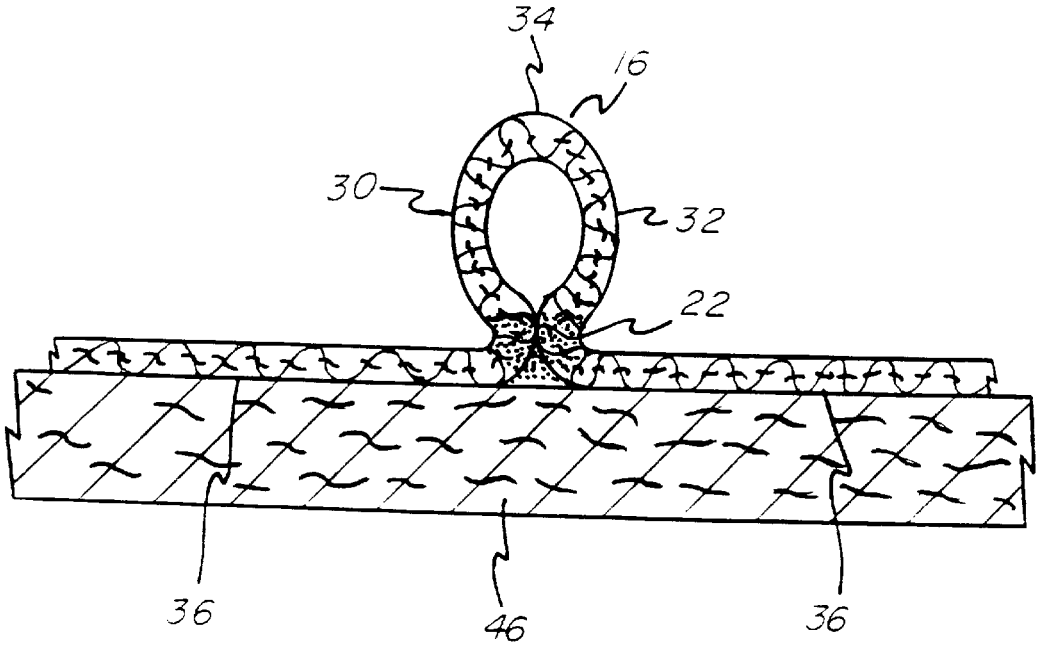
FIG. 4 is a cross-sectional view taken along line 4—4 of FIG. 1.
Figure 5:
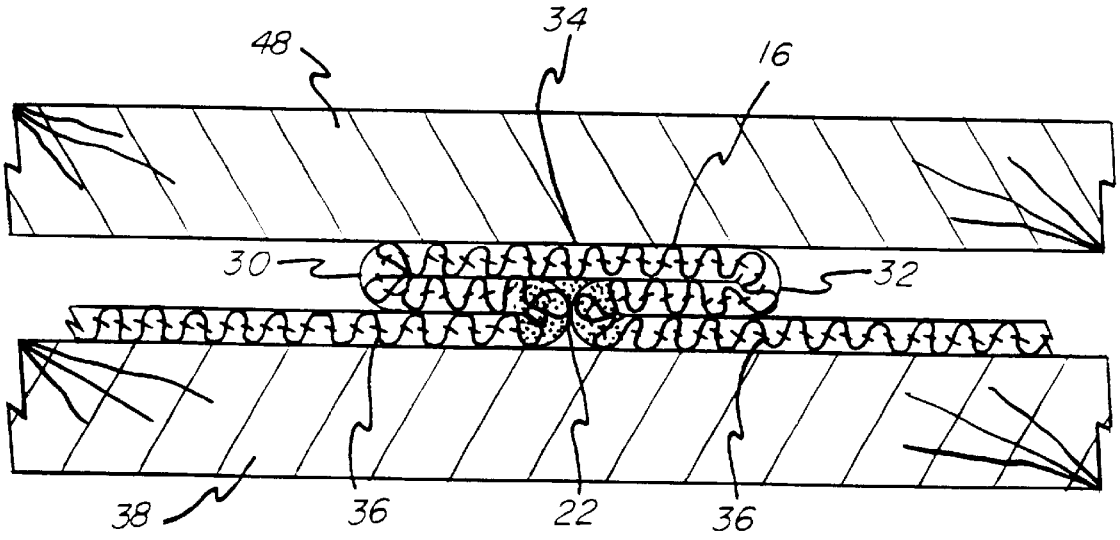
FIG. 5 is a cross-sectional view taken along line 5—5 of FIG. 1.

Referring now to FIGS. 3 and 4, each pleat 16 is formed by first and second pleat panels 30 and 32 connected at a first, or inner, end by one of the securing lines 22 and joined at an opposing second, or outer, end by an apex 34. Adjacent pleats 16 are joined by connecting, or overlapping, panels 36 extending substantially parallel to the wall 10 between successive securing lines 22. The top and bottom edges 18 and 20 of the pleated material 14 are secured to upper and lower planar mounting surfaces 37 and 39 of upper and lower mounting strips 38 and 40.

The upper and lower mounting strips 38 and 40 are secured to the wall 10 (FIG. 2) in substantially parallel relation, wherein the lower mounting strip 40 is positioned below the upper mounting strip 38. The mounting strips 38 and 40 preferably comprise traditional wood nailers. Staples 42 are preferably utilized to secure the material 14 to the mounting strips 38 and 40 while nails 44 are preferably used to fix the mounting strips 38 and 40 to the wall 10. Sound insulation 46 may extend between the upper and lower mounting strips 38 and 40 as may be required for a particular installation.

Referring now to FIGS. 2–5, the upper and lower portions 24 and 26 of the pleats 16 are secured to the upper and lower mounting strips 38 and 40 such that the first and second pleat panels 30 and 32 overlie adjacent connecting panels 36. The first and second pleat panels 30 and 32 define the apex 34 which is secured substantially flat in proximity with the upper and lower mounting strips 38 and 40 at the upper and lower portions 24 and 26 of the pleat 16. Moreover, the upper and lower portions 24 and 26 of each first and second pleat panel 30 and 32 is disposed substantially parallel with, and partially overlaps, adjacent connecting panels 36. The apex 34 extends outwardly away from the wall 10 as the pleats 16 extend from the upper and lower portions 24 and 26 toward the center axis 28 disposed intermediate the upper and lower portions 24 and 26. The apex 34 is symmetrically disposed between the first and second pleat panels 30 and 32 along the full length of each pleat 16 between the upper and lower portions 24 and 26.

The securing lines 22 may comprise any conventional securing means, including stitching, adhesive or ultrasonic welding. However, it should be appreciated that equivalent bonding means may be readily substituted therefor. The securing lines 22 extend in a plane substantially parallel to the wall 10. Upper and lower facia strips 48 and 50 may be attached by fasteners, such as staples 49, over each of the upper and lower mounting strips 38 and 40 to provide an aesthetically pleasing finished appearance. Moreover, planar mounting surfaces 45 and 47 of the upper and lower facia strips 48 and 50 cooperate with the essentially flat surfaces defined by the upper and lower portions 24 and 26 of the pleats 16 and adjacent connecting panels 36 (FIG. 3).

Figure 6:
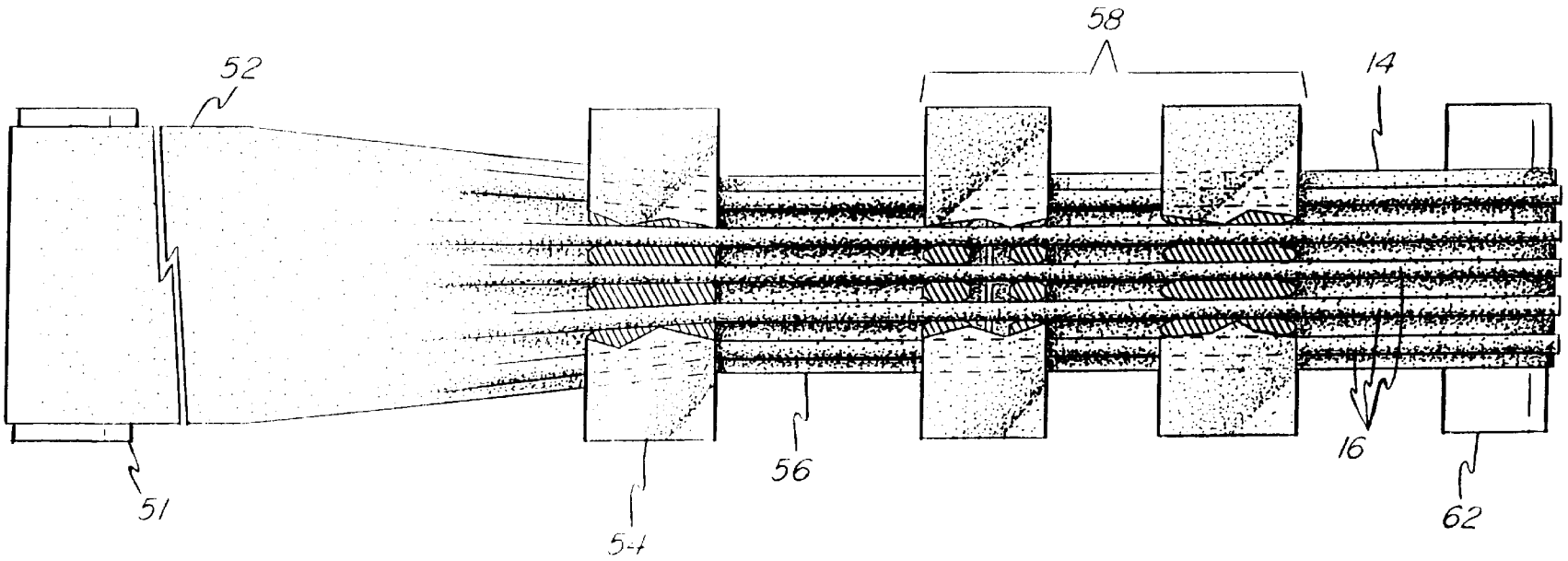
FIG. 6 is a schematic view, with partial cutaway, of the apparatus of the present invention for producing the pleated wall covering material as utilized in the wall covering system of FIG. 1.

Turning now to FIG. 6, the method of producing the pleated material 14 of the present invention comprises providing a source 51 of planar material 52 and then passing the planar material 52 through a pleating device 54. The source 50 of planar material 52 preferably comprises a conventional roll stand while the pleating device 54 preferably comprises a die for forming the longitudinally extending pleats 16 within the material 50. The pleating device 54 may comprise a series of rods, bars or wheels for forming the pleats 16 within the material 50, although similar structures may be readily substituted therefor.

The newly pleated material 56 then travels downstream to a securing device 58 which permanently fixes the pleats 16 within the final pleated material 14. The securing device 58 includes a plurality of fixing elements 60 for simultaneously fixing the plurality of pleats 16 through securing lines 22 extending longitudinally along the entire length of the material 14. The securing device 58 may produce securing lines 22 comprising stitches, adhesive or ultrasonic welds. Ultrasonic welding is the preferred method of forming the securing lines 22 wherein the fibers of the material 14 are molecularly bonded together.

As illustrated in FIG. 6, the planar material 52 reduces in width as the pleats 16 are formed. For example, a planar material 52 having a width of approximately 54 inches forms a final pleated material 14 having a width of approximately 39 inches. Once the final wall covering material 14 is produced, the pleats 16 are preferably folded flat against adjacent connecting panels 36 and the material 14 is then wrapped around a take-up, or collection, roll 62 which then may be delivered to the job site for installation within the wall covering system 12 of the present invention.

Installation of the wall covering system 12 of the present invention typically begins by installing the upper and lower mounting strips 38 and 40 in the desired locations on the wall 10 by inserting nails 44 therethrough. Next the pleated material 14 is unwrapped from the take-up roll 62 and cut to the desired length, i.e., approximately the height between the upper and lower mounting strips 38 and 40. The top edge of the pleated material 14 is then fixed along the upper mounting strip 38. The material 14 is then stretched down to the lower mounting strip 40 where the bottom edge is fixed in place, after ensuring that all the pleats 16 are disposed in substantially parallel vertical relation to each other, i.e., vertical plumb. Thereafter, the facia strips 48 and 50 are installed over the pleated material 14 and secured to the mounting strips 38 and 40.

If desired, it may not be necessary to provide an upper facia strip 48 in a room or hall having a high wall 10, as the upper mounting strip 38 may not be readily observable by a person standing below.

While the process and product herein described constitute a preferred embodiment of the invention, it is to be understood that the invention is not limited to this precise process and product, and that changes may be made therein without departing from the scope of the invention, which is defined in the appended claims.

What is claimed is:

1. A wall covering for application to a wall, said wall covering comprising:

a sheet of flexible material including top and bottom edges and a center axis extending laterally in a substantially horizontal direction;

a plurality of substantially parallel pleats formed within said sheet and extending longitudinally in a substantially vertical direction, each said pleat including upper and lower portions adjacent said top and bottom edges of said sheet;

wherein each said pleat includes first and second pleat panels extending outwardly from adjacent the wall proximate said center axis, said first and second pleat panels each having opposed inner and outer ends, said outer ends of said first and second pleat panels of each said pleat joined at an apex, said apex substantially symmetrically disposed intermediate said first and second pleat panels of each said pleat and extending in a substantially vertical direction between said upper and lower portions;

a plurality of substantially parallel securing lines, each said securing line joining said inner ends of said first and second pleat panels of one of said pleats, said securing line extending continuously in a substantially vertical direction from said top edge to said bottom edge of said sheet; and a plurality of planar connecting panels, each said connecting panel extending substantially parallel to the wall between successive securing lines and connecting adjacent ones of said pleats.

2. The wall covering of claim 1 further comprising:

an upper mounting strip having an upper planar mounting surface and adapted to be mounted to the wall, said top edge of said sheet secured to said upper planar mounting surface; and a lower mounting strip having a lower planar mounting surface and adapted to be mounted to the wall, said bottom edge of said sheet secured to said lower planar mounting surface.

3. The wall covering of claim 2 wherein said upper mounting strip and said lower mounting strip are formed of wood.

4. The wall covering of claim 2 further comprising:

an upper facia strip covering said upper mounting strip and said top edge of said sheet secured to said upper planar mounting surface; and a lower facia strip covering said lower mounting strip and said bottom edge of said sheet secured to said lower planar mounting surface.

5. The wall covering of claim 1 wherein said first and second pleat panels of each said lower portion are disposed in substantially parallel and partially overlapping relation with adjacent ones of said connecting panels.

6. The wall covering of claim 5 wherein said apex of each said lower portion is fixed proximate said securing line whereby said pleat is disposed substantially parallel to the wall.

7. The wall covering of claim 6 wherein said first and second pleat panels of each said upper portion are disposed in substantially parallel and partially overlapping relation with adjacent ones of said connecting panels.

8. The wall covering of claim 7 wherein said apex of each said lower portion is fixed proximate said securing line whereby said pleat is disposed substantially parallel to the wall.

9. The wall covering of claim 1 wherein said apex of each said pleat extends in a direction outwardly away from the wall as said pleat extends in a direction from said upper portion towards said center axis.

10. The wall covering of claim 9 wherein said apex of each said pleat extends in a direction outwardly away from the wall as said pleat extends in a direction from said lower portion towards said center axis.

11. The wall covering of claim 1 wherein said securing lines comprise stitching.

12. The wall covering of claim 1 further comprising insulation disposed intermediate said sheet and the wall.

13. A wall covering system comprising:

an upper mounting strip including an upper planar mounting surface, said upper mounting strip adapted to be supported by a wall;

a lower mounting strip including a lower planar mounting surface, said lower mounting strip positioned below said upper mounting strip and adapted to be supported by the wall;

a pleated sheet of material including top and bottom edges and a center axis extending laterally in substantial parallel relation with said top and bottom edges, said top edge secured to said upper mounting strip and said bottom edge secured to said lower mounting strip;

a plurality of substantially parallel pleats formed within said sheet and extending longitudinally in a substantially vertical direction between said upper and lower mounting strips, each said pleat including upper and lower portions adjacent said top and bottom edges of said sheet;

a plurality of planar connecting panels, each said connecting panel extending substantially parallel to the wall and connecting adjacent ones of said pleats;

each said pleat includes first and second pleat panels extending outwardly from adjacent the wall intermediate said upper and lower portions, said upper and lower portions of each said pleat fixed to said upper and lower planar mounting surfaces of said upper and lower mounting strips, wherein said first and second pleat panels of said upper and lower portions are disposed in substantially parallel and partially overlapping relation with adjacent ones of said connecting panels; and a plurality of substantially parallel securing lines, each said securing line joining said first and second pleat panels of one of said pleats proximate adjacent ones of said connecting panels, said securing line extending continuously in a substantially vertical direction from said top edge to said bottom edge of said sheet and oriented in a plane extending substantially parallel to said connecting panels.

14. The wall covering system of claim 13 wherein said first and second pleat panels include opposed inner and outer ends, said outer ends of said first and second pleat panels of each said pleat joined at an apex, said apex substantially symmetrically disposed intermediate said first and second pleat panels of each said pleat and extending in a substantially vertical direction between said upper and lower portions.

15. The wall covering system of claim 14 wherein said apex of each said pleat extends in a direction outwardly from the wall as said pleat extends in a direction from said upper portion towards said center axis and in a direction from said lower portion towards said center axis.

16. The wall covering system of claim 13 further comprising:

an upper facia strip covering said upper mounting strip and said top edge of said sheet secured to said upper planar mounting surface; and a lower facia strip covering said lower mounting strip and said bottom edge of said sheet secured to said lower planar mounting surface.

17. The wall covering system of claim 13 wherein said apex of each said lower and upper portion is fixed proximate said securing line whereby said pleat is disposed substantially parallel to the wall at said upper and lower portions.

* * * * *